US005934579A

United States Patent [19]

Hiersche et al.

[11] Patent Number: 5,934,579

[45] Date of Patent: Aug. 10, 1999

[54] APPARATUS FOR TREATING SUSPENSIONS

[75] Inventors: Wolfgang Hiersche; Wilfried Knott; Andreas Mehrwald, all of Essen, Germany

[73] Assignee: Th. Goldschmidt AG, Essen, Germany

[21] Appl. No.: 08/832,452

[22] Filed: Apr. 3, 1997

[30] Foreign Application Priority Data

Apr. 3, 1996 [DE] Germany ..... 196 13 366

[51] Int. Cl.[6] ..... B02C 17/16

[52] U.S. Cl. ..... 241/65; 241/171; 241/172

[58] Field of Search ..... 241/171, 172, 241/65, 46.17

[56] References Cited

U.S. PATENT DOCUMENTS

| | | | |
|---|---|---|---|
| 3,998,938 | 12/1976 | Szegvari | 241/46.17 |
| 4,998,678 | 3/1991 | Durr | 241/172 |
| 5,184,783 | 2/1993 | Hockmeyer et al. | 241/172 |
| 5,346,147 | 9/1994 | Ishikawa et al. | 241/172 |

FOREIGN PATENT DOCUMENTS

| | | | |
|---|---|---|---|
| 295 18 987 U | 2/1996 | Germany . | |
| WO 89/11911 | 12/1989 | WIPO | 241/172 |

*Primary Examiner*—Mark Rosenbaum
*Attorney, Agent, or Firm*—Scully, Scott, Murphy & Presser

[57] ABSTRACT

An apparatus designed for the batchwise treatment of suspensions comprises a cylindrical reaction vessel (1) which is rotationally symmetric with respect to an axis (4) and within which, in a coaxial arrangement with respect to said axis (4), an insertion member (28') is disposed which includes a grinding cage (31) and the grinding bed formed by grinding balls (25). By means of delivery elements and stirring elements (35, 37) a suspension stream is generated which passes through the grinding bed in the direction of the arrows (28), leaves the insertion member (28') in the upper region thereof via radially oriented orifices (13) and is circulated via the annular chamber (15) of the reaction vessel (1). The reaction vessel (1) is of pressure-tight design, and heterogenous reactions can proceed inside it in vacuum or pressurized mode.

28 Claims, 5 Drawing Sheets

APPARATUS FOR TREATING SUSPENSIONS

FIELD OF THE INVENTION

The invention relates to an apparatus for treating suspensions, by means of a grinding system arranged integrally with a stirring system.

BACKGROUND OF THE INVENTION

For the purpose of treating suspensions, in particular to comminute their solids fraction, grinding systems are known in which the suspension to be treated is circulated via a dispersing unit and a ball mill. Via a feed pump which is inserted, at a suitable position, into the conduit connecting the dispersing unit to the ball mill, the suspension is circulated within said circulation arrangement. Such grinding systems are employed, for example, to process paints and pigment paste.

Further examples of grinding systems designed for batchwise treatment of solids in liquids comprise a stirred mill unit which, by means of a hydraulically actuated lifting column, can be lowered into a vessel holding the suspension to be treated and whose constructional design corresponds to the known dissolvers. Via the rotation of a perforated basket, the suspension is subjected to a circulatory effect, and said product vessel may, for the purpose of keeping within temperature limits, be designed to be coolable, i.e. of double-walled design. Moreover it is possible, by virtue of a sealed vessel cover, to achieve substantially low-emission comminution. Such stirred mills are known, for example, from the "NETSCH-Turbomill" brochure from NETSCH.

These known grinding systems are distinguished by a relatively complex construction, or the grinding process is carried out, in part, in an open system. A further aspect in some cases is an inadequate circulatory effect and—related thereto—a reduced grinding action. This deficiency becomes all the more important in systems involving difficult rheology. For example, certain systems, when being pumped, show a tendency to solvent depletion, which causes caking, blockages and sedimentation.

DE 295 18 987 U1 discloses a dispersing apparatus which comprises a stirred ball mill which is positioned in a height-adjustable manner within a vertically disposed cylindrical vessel and underneath which—in a fixed height position relative to the vessel—a flow generation apparatus in the form of a dissolver is installed. The stirred ball mill comprises a housing which is perforated like a sieve and is in the form of a toroidal annular duct which extends coaxially with respect to the vessel axis and whose outer periphery is maintained at a distance from the inside of the housing, said annular duct enclosing a central opening through which runs the dissolver drive shaft, which extends in the axial direction of the vessel. Said drive shaft is guided, at the top end of the vessel, in a tubular shaft by means of which the agitator, which is situated within the stirred ball mill and is formed by a system of annular disks, can be driven. The agitator on the one hand and the dissolver on the other hand can be driven by means of drives situated outside the vessel—alternatively, however, a common drive for both apparatuses can be provided. Apart from this, the stirred ball mill is suspended on rods within the vessel, and a further driving means is provided for adjusting the height. Whereas the dissolver effects predispersion of the material to be dispersed, with the stirred ball mill in a raised position, i.e. outside the material to be dispersed, lowering the stirred ball mill achieves not only a grinding action but also achieves fine dispersion. In the lowered state, the sieve-like housing of the stirred ball mill is immersed into the material to be dispersed, which has been set into a rotary flow motion by the dissolver, the field of flow which is being established forming a circulation which partially permeates said housing. The advantage of this known apparatus is that said circulation is established entirely within the reaction vessel. The emphasis, however, is on the dispersing operation, and the achievable grinding action depends on the particular way of guiding the flow within the circulation.

BRIEF SUMMARY OF THE INVENTION

The object of the invention is to design an apparatus of the abovementioned type in such a way that said apparatus, while being of simple constructional design, enables not only the size reduction process, but also makes it possible to carry out heterogeneous reactions related to the size reduction process and is suitable, in particular, for operation at positive and negative pressure and takes account of the Theological problems, indicated at the outset, of material systems. This object has been achieved in such an apparatus by an apparatus for treating suspensions, which comprises means for grinding and means for stirring both of which are integrated into a circulation arrangement for the suspensions, and further comprises a reaction vessel (1) in association with which said grinding means and stirring means are arranged, the reaction vessel (1) which accommodates the circulation arrangement being constructed, including the grinding means and the stirring means, as a closed system designed for batchwise operation, wherein (a) the grinding means comprises a grinding cage (19, 31, 40, 54, 65) which has a drive shaft (22, 29, 43) passing through it centrally, (b) the grinding cage (19, 31, 40, 54, 65) is arranged in a globally tubular insertion member (11, 28', 41, 11') or in a bypass line whose entire cross section it occupies, (c) the apparatus further comprises an element for one or both of stirring and delivery disposed within the insertion member or in the bypass line—adjacent to the top or bottom of the grinding cage (19, 31, 40, 65)—or in the bypass line, either upstream and/or downstream of the grinding cage (54), and (d) said element for one or both of stirring and delivery is selected from the group consisting of propeller stirrers (26, 27, 37, 46), anchor agitators (35, 63) and turbine impellers (51, 64).

DETAILED DESCRIPTION OF THE INVENTION

Figure 1:
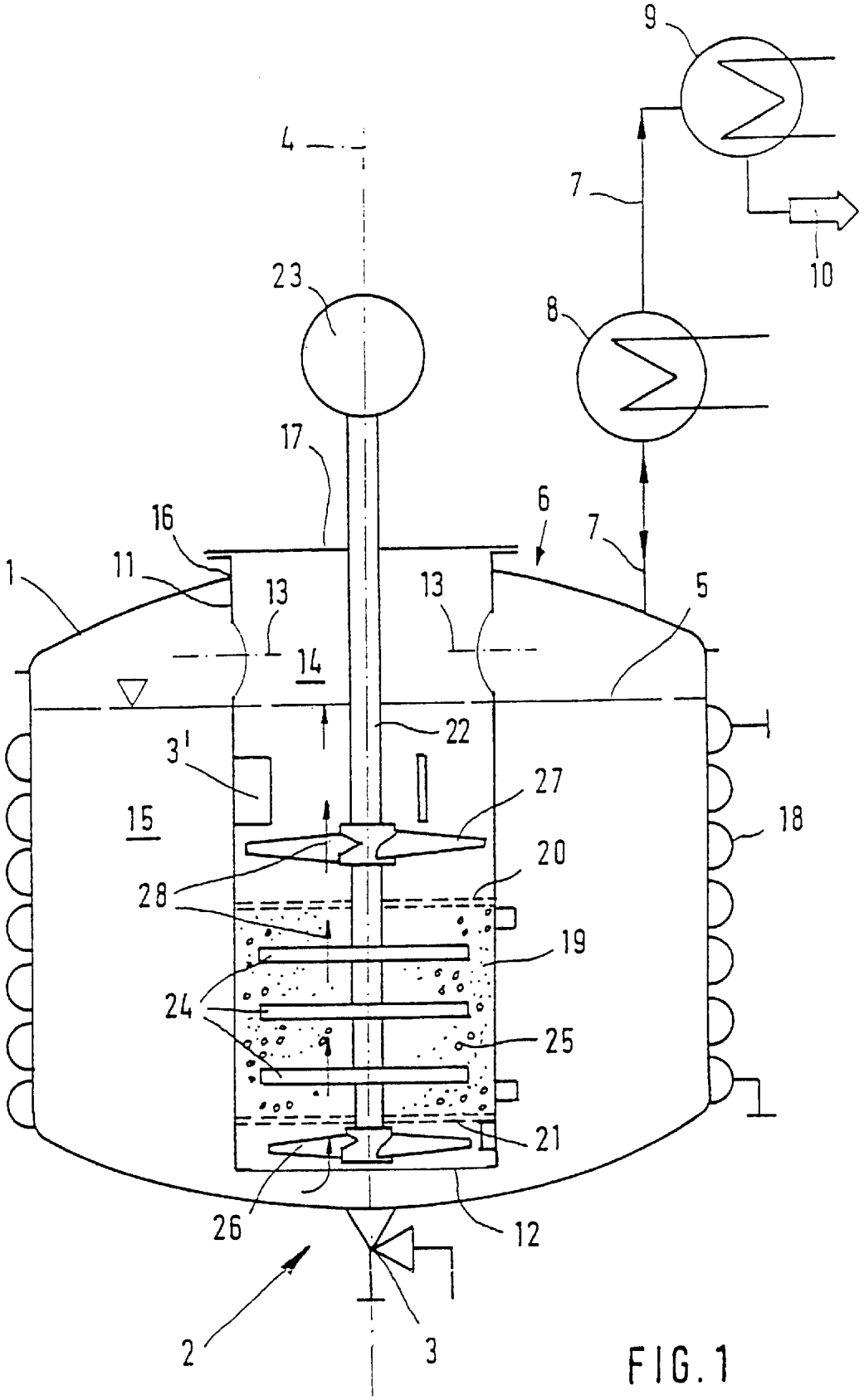
FIGS. 1–5 are longitudinal cross-sectional views of five different embodiments of the invention.

The invention is based on a reaction vessel which delimits a closed reaction chamber and which comprises the essential components of the apparatus, i.e. a grinding system and a stirring system. The reaction vessel is designed to be pressure-tight and to be equally suitable for operation at positive and negative pressure. The circulation to which the suspension to be treated is subjected takes place in said reaction chamber, which is hermetically sealed with respect to the outside, thus ensuring that the suspension is positively directed between the grinding and the stirring system and thus also undergoes effective grinding. The enclosed, compact system permits even heterogeneous reactions between solids, liquids and gases to be carried out within the reaction vessel, without external reaction loops having to be passed through. In the grinding system, a fixed grinding cage is employed which is connected to the reaction vessel and carries a charge of grinding balls having a diameter of, for example, from 1 mm to 5 mm, which may, for example, fill said cage to a filling ratio of about 80%. The size and material of the grinding media or grinding balls are selected depending on the solids to be ground and the desired grinding quality, in particular the fineness of the particles carried in the suspension. According to the invention, the grinding cage is located in a tubular insertion member, which is expediently inserted, in a sealing manner, from the top of the reaction vessel into an opening located therein. The quality of said seal is selected depending on the process parameters of the grinding process, in particular taking into account operation at positive and negative pressure, and the characteristics of the suspension to be treated. Within said insertion member the grinding system is located at an end zone, and in addition at least one stirring and/or delivery element is provided, which is expediently located adjacent to the grinding system. As a result of such a delivery element being located within the tubular insertion member, an improved delivery effect acting on the suspension to be treated is achieved, said suspension thus being subject to an intensive circulation effect. Alternatively, the grinding cage may be located in a bypass line, stirring and/or delivery element being located on one side or on both sides of the grinding cage, which is again delimited frontally, for example, by perforated plates. The stirring and/or delivery elements employed according to the invention are various types of stirrers, e.g. propeller stirrers, anchor agitators or turbine impellers. The stirrer type employed in any particular case is chosen in accordance with its intended use, namely, on the one hand, to ensure positive guidance for the suspension to be treated, and thus circulatory motion thereof, and, on the other hand, to maintain a satisfactory condition of the dispersion within the suspension, in particular to prevent solids from being deposited. Since the normal operating speeds of relatively slowly rotating anchor agitators, paddle agitators or gate paddle agitators differ from those of relatively rapidly rotating propeller stirrers and turbine impellers, it will in some cases be necessary or expedient to use different drives, depending on the stirrer types employed in any particular case.

The grinding and stirring system may have joint drive units—alternatively, separate drive units may be provided for both systems. The latter has the advantage of more extensive control of the parameters which are essential for the stirring and grinding process.

The reaction vessel is preferably designed as a rotationally symmetric vessel within which the grinding and stirring system can be arranged centrally, coaxially or even eccentrically. In this arrangement, the grinding and stirring system may be designed as a compact assembly, but alternatively, these systems may be arranged separately from one another in the circulation arrangement inside the reaction vessel. Furthermore, functional elements of the stirring system may also be arranged in the immediate vicinity of the grinding system. Crucial for the distribution of these functional elements along said circulation arrangement for the suspension are the rheological characteristics thereof, to which the design of said elements is matched. Thus the satisfactory condition of the dispersion within the suspension must be maintained, and it must be ensured that the suspension experiences positive guidance through the grinding bed of the grinding system within the circulation arrangement mentioned at the outset.

In accordance with an embodiment of the invention, the axis of the grinding system can run parallel to the axis of the reaction vessel. This is a preferred orientation of said axis—it is equally possible, however, depending on the particular geometric design of the reaction vessel, for the axis of the grinding system to run at any angle with respect to the axis of the reaction vessel.

The drive units are preferably situated outside the reaction vessel, in particular outside its reaction chamber. This requires suitable seals to be employed or the use of split-cage drives or of magnetic drives in the case of special requirements with respect to pressure tightness and freedom from leaks. The drive units generally comprise motor/gear units, with the option of using variable-speed gears to accomplish controllable rotational speeds. Of particular advantage, however, are purely electric speed control systems, for example based on frequency control in the case of single—or multiphase AC motors. In principle, however, variable-speed DC drives may also be considered.

In an alternative accommodation of the grinding system, the grinding system can be located in a bypass line which communicates with the reaction vessel. In principle it is also possible for a plurality of bypass lines to be assigned to the reaction vessel, so as to generate a particularly intensive grinding action, each bypass line communicating with the reaction vessel via two connection points and a plurality of pairs of such connection points being allocated to the reaction vessel and preferably being distributed uniformly over the circumference. This arrangement of the grinding system provides for improved access facilities for maintenance and inspection purposes.

The apparatus of the invention can include features which address options for regulating the temperature of the suspension during the treatment process by means of a cooling or heating means with which the apparatus is equipped. For instance, the cooling or heating means can comprise a double-walled reaction vessel to create a jacket which carries heat transfer medium; or a coiled pipe can be disposed outside the reactor. In either case, the circuit carrying the heat transfer medium also includes a sink and/or a heat source. Via a heat transfer medium it is thus possible either to introduce heat into the reaction chamber or alternatively, in the same way, to remove heat therefrom. A further heat removal option, which is suitable, in particular, for low-boiling-point components, is to attach one or more reflux condensers.

The apparatus can also include grinding disks joined to the drive shaft and located for instance inside a grinding cage. The grinding cage includes an inner chamber containing an adjustable amount of grinding media such as grinding balls. The grinding cage is equipped with inlet and outlet orifices which prevent the grinding media from passing through but permit the suspension to flow through. The grinding disks are provided with openings taking the form of slots, spirals, crosses etc. and in the course of the rotary motion act on the grinding balls so as to entrain them.

The grinding cage is preferably equipped with inlet and outlet orifices, formed by screen areas, for the suspension to be treated and is preferably designed so as to be rotationally symmetric with respect to the axis of the grinding system.

In other preferred embodiments these grinding cage orifices which serve to guide the suspension through the grinding bed can be formed as perforated plates at the end faces of the grinding cage, or as end-side circumferential sections of the grinding cage, which are designed as sieve sections. If the design of the grinding cage is cylindrical, these orifices may be arranged either in the front ends of the grinding cage or in those sections of the periphery which are adjacent to each of these front ends. The latter version provides for favorable ways of supporting the drive shaft of the grinding and stirring system at the front ends designed as circular plates and also for a larger screen area to reduce pressure losses.

In other embodiments, the bottom end face of the insertion member forms the inlet port and upper radially oriented orifices of the insertion member form the outlet port, or vice versa.

The grinding cage can be disposed at the end of the insertion member which is adjacent to the bottom end face, and extends axially over part of the length of the insertion member.

Alternatively, the insertion member can be inserted in a sealing manner into an opening at the top of the reaction vessel, and said member is closed at the top in a sealing manner by a cover plate which also serves to guide the drive shaft.

The drive shaft of the grinding system can be passed in a sealing manner through an opening in the wall of the bypass line. In this embodiment, the grinding cage can be accommodated in a tubular chamber which forms an integral part of the bypass line. Thus, the tubular chamber extends coaxially with respect to the axis of the grinding system, and the tubular chamber at its inlet and outlet side merges via tapering pipe sections with adjoining elements of the bypass line. The cross section is wider than the other conduit sections of the bypass line, so that an adequate grinding chamber volume is provided. This affords the additional advantage, within the grinding bed, of a reduced flow velocity, a longer residence time and thus an improved grinding action.

The tubular chamber is adjoined by, for example, conical transitional pipe sections. In accordance with another embodiment, at least one stirring and/or delivery element is outside said pipe sections, i.e. at some other suitable point within the bypass line.

Addressing the more detailed design of the bypass line, in a preferred embodiment thereof the end face (12) of the insertion member (11, 28', 41, 11') or the first connection point of the bypass line is situated at a distance from the bottom region of the reaction vessel (1), and the orifices (13) of the insertion member (11, 28', 41, 11') or the other connection point of the bypass line are situated at a distance from the top terminal wall of the reaction vessel (1). This may comprise, for example, identical pipe elbows which are fitted at said connection points of the reaction vessel and, with the interposition of conically flared pipe sections, establish the connection to the abovementioned tubular or grinding chamber.

Preferably, the bottom and the upper terminal wall of the reaction vessel are of structurally identical design, such as the surface of a sphere or cone, such design being very simple in geometric terms. The bottom section, in particular, being of conical design or shaped like a spherical surface, counteracts the deposition of solids, the type of stirring elements expediently being chosen so as to ensure that the flow thereby induced in the suspension uniformly covers every region of the bottom face.

Addressing further options for improving the dispersion action to be exerted on the suspension to be treated, the apparatus can be constructed such that within the reaction vessel (1) at least one insert (61) is arranged, which has a funnel-like central opening (62) and divides the inner chamber of the reaction vessel (1) into two chambers which communicate via said opening in a way so as to permit suspension to pass through, the drive shaft (52) being passed through the opening (62), and different stirring elements (63, 64) in the chambers being joined to the drive shaft (52) in a torsion-proof manner. By a suitable choice of the stirring elements employed in the different chambers it is thus possible to introduce additional turbulence into the flow, thus counteracting the deposition of solids.

In accordance with further features of the invention, the insertion member and/or the grinding cage is/are equipped with service ports (removal ports and charging ports) for removing grinding balls or for introducing grinding balls. Particularly if the grinding cage is arranged in a bypass line to the reaction vessel, such maintenance work related to the removal of grinding media and to the introduction of grinding media is relatively simple.

In accordance with another feature, the reaction vessel can be fitted with a discharge line for a vaporous reaction product. Since the reaction vessel is a hermetically sealed system permitting input and removal of heat and thus a treatment process at high operating temperature, in particular close to the boiling point, it is possible for the vaporous reaction product to be obtained in liquid form via a condenser arranged in said discharge line. Upstream installation of a reflux condenser which is designed to carry out partial condensation provides the option of working up the reaction product by distillation in order to increase the "purity" of the liquid product recovered in the condenser. Optionally, the reflux condenser can be replaced by a rectifying column, which allows a volatile reaction product to be isolated in higher purity.

A discharge element for a free-flowing reaction product such as a liquid, can be provided in the upper region of the reaction vessel. Also, a supply or feeder element for the suspension to be treated can be provided in the upper region of the reaction vessel. The reaction vessel according to the invention is basically designed for batchwise operation which envisages multiple recirculation of the suspension to be treated within a circuit containing the grinding system.

In principle, however, it is also possible to use the reaction vessel in a continuous grinding process.

Figure 2:
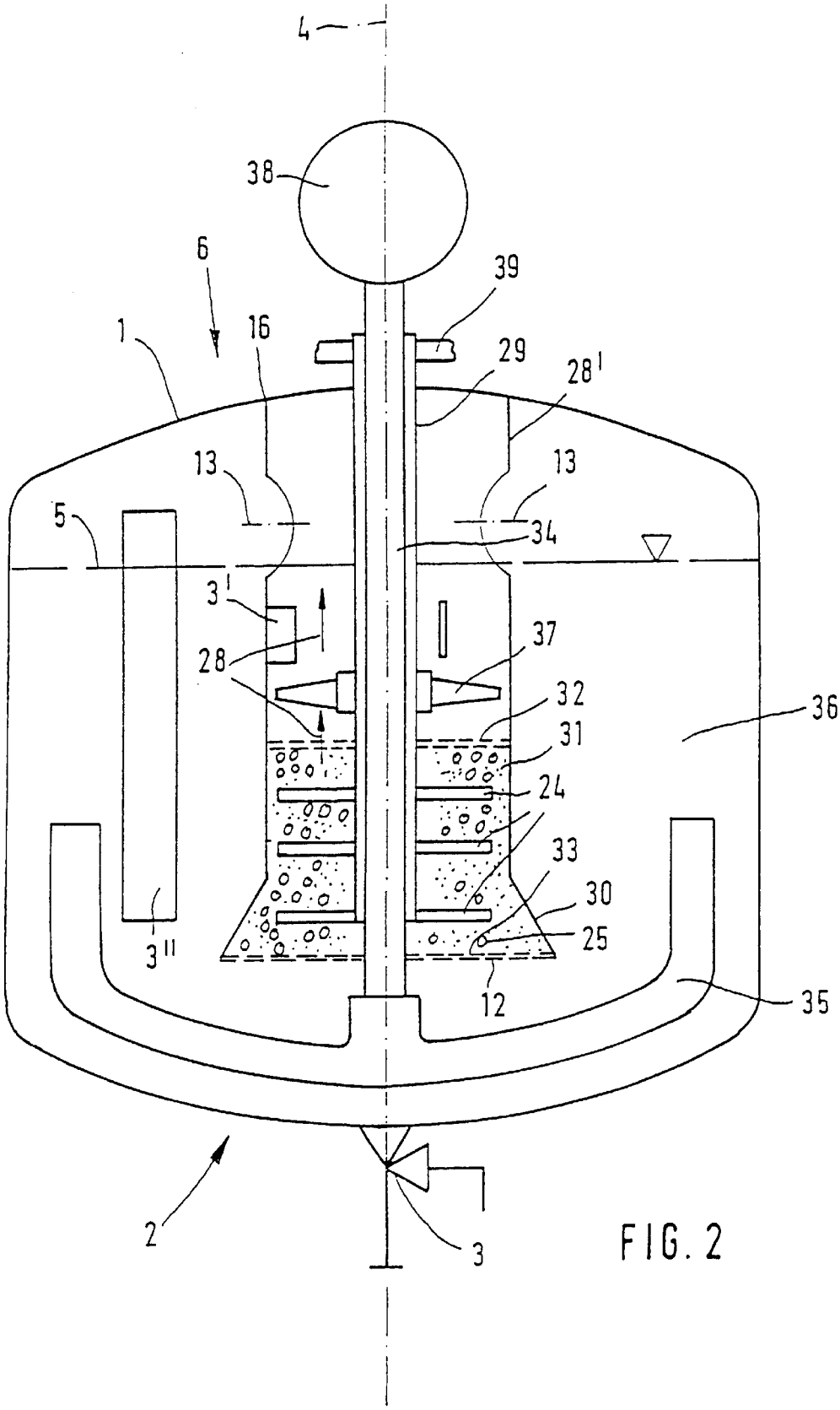
Figure 3:
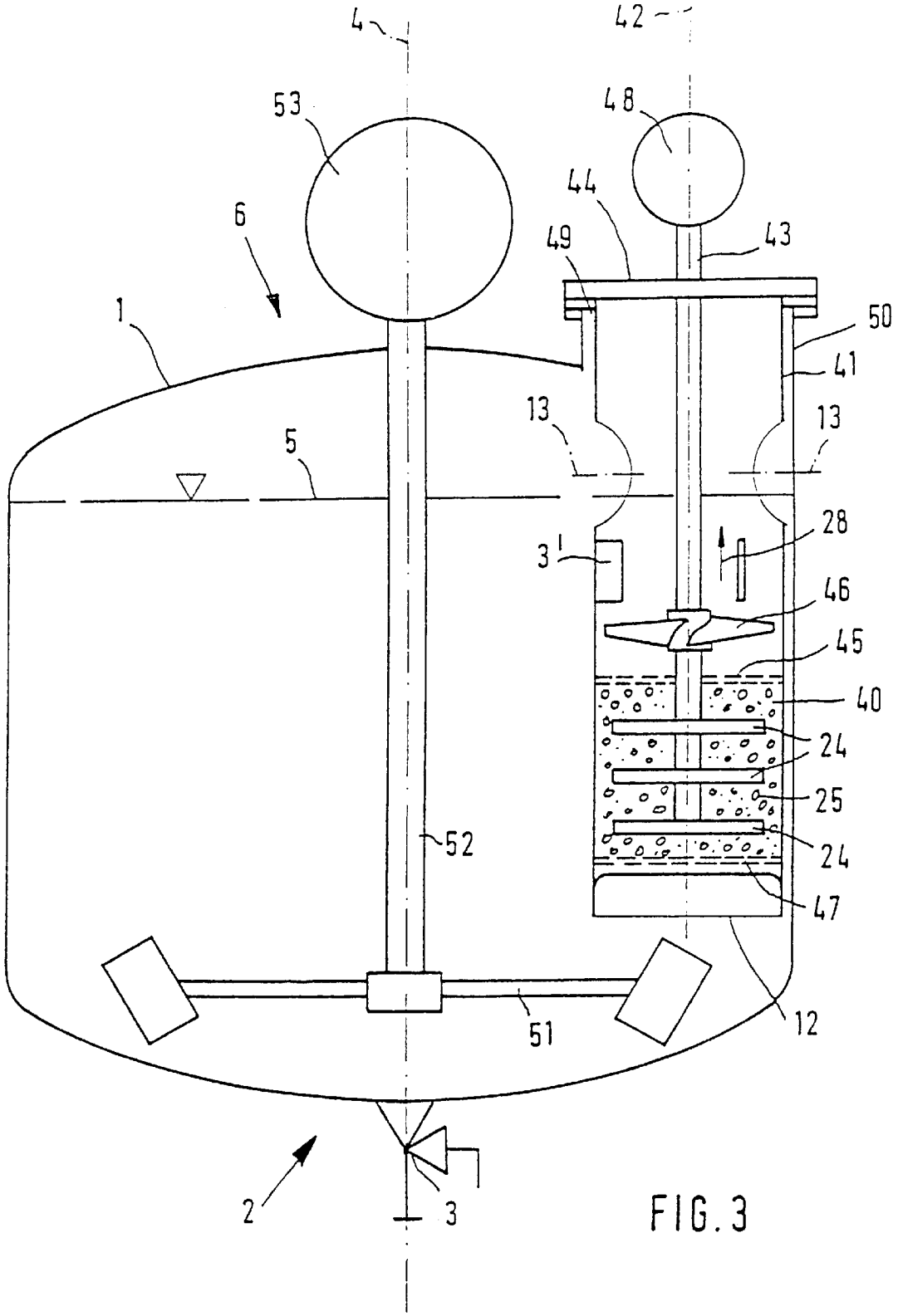
Figure 4:
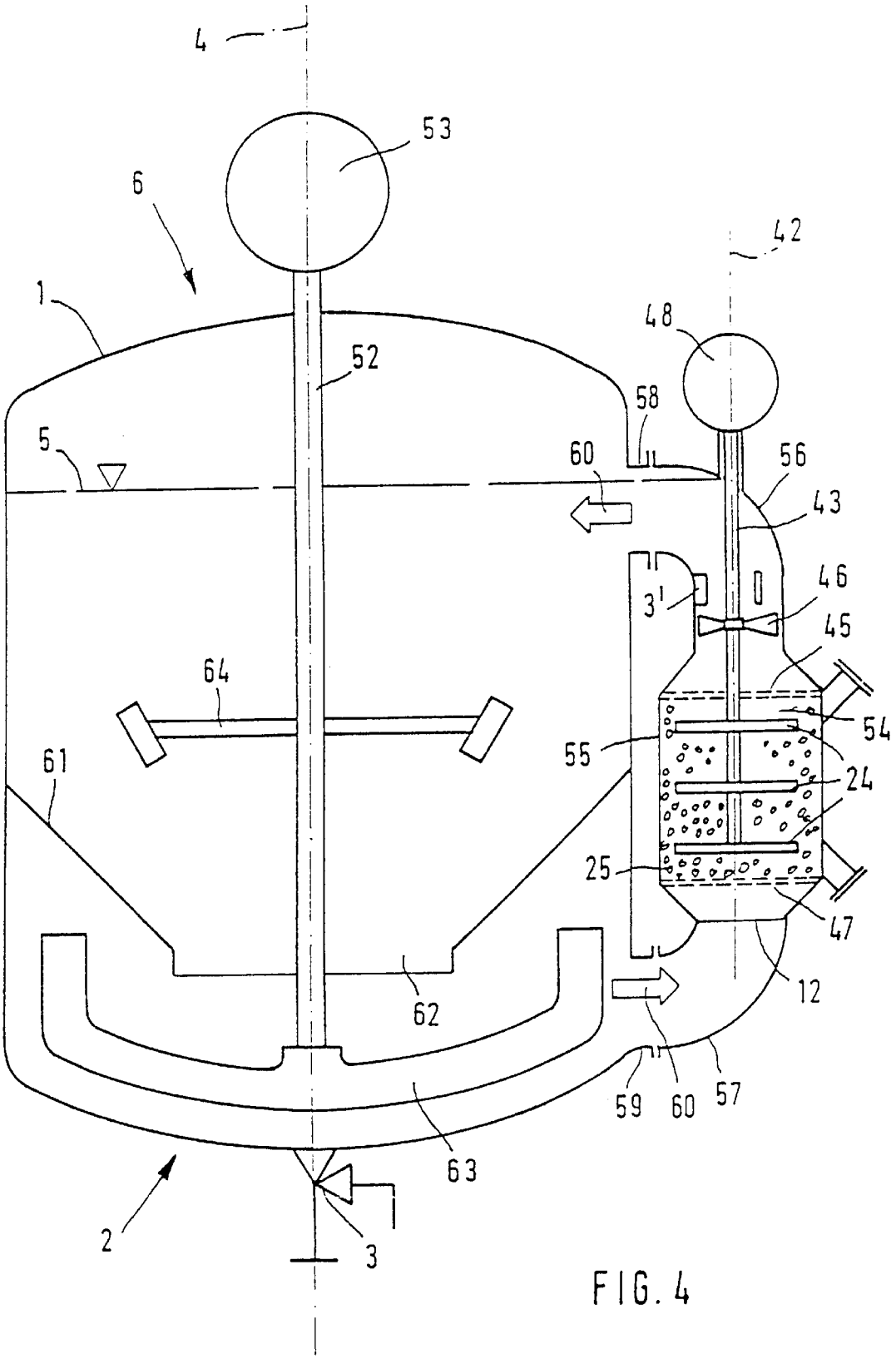
Figure 5:
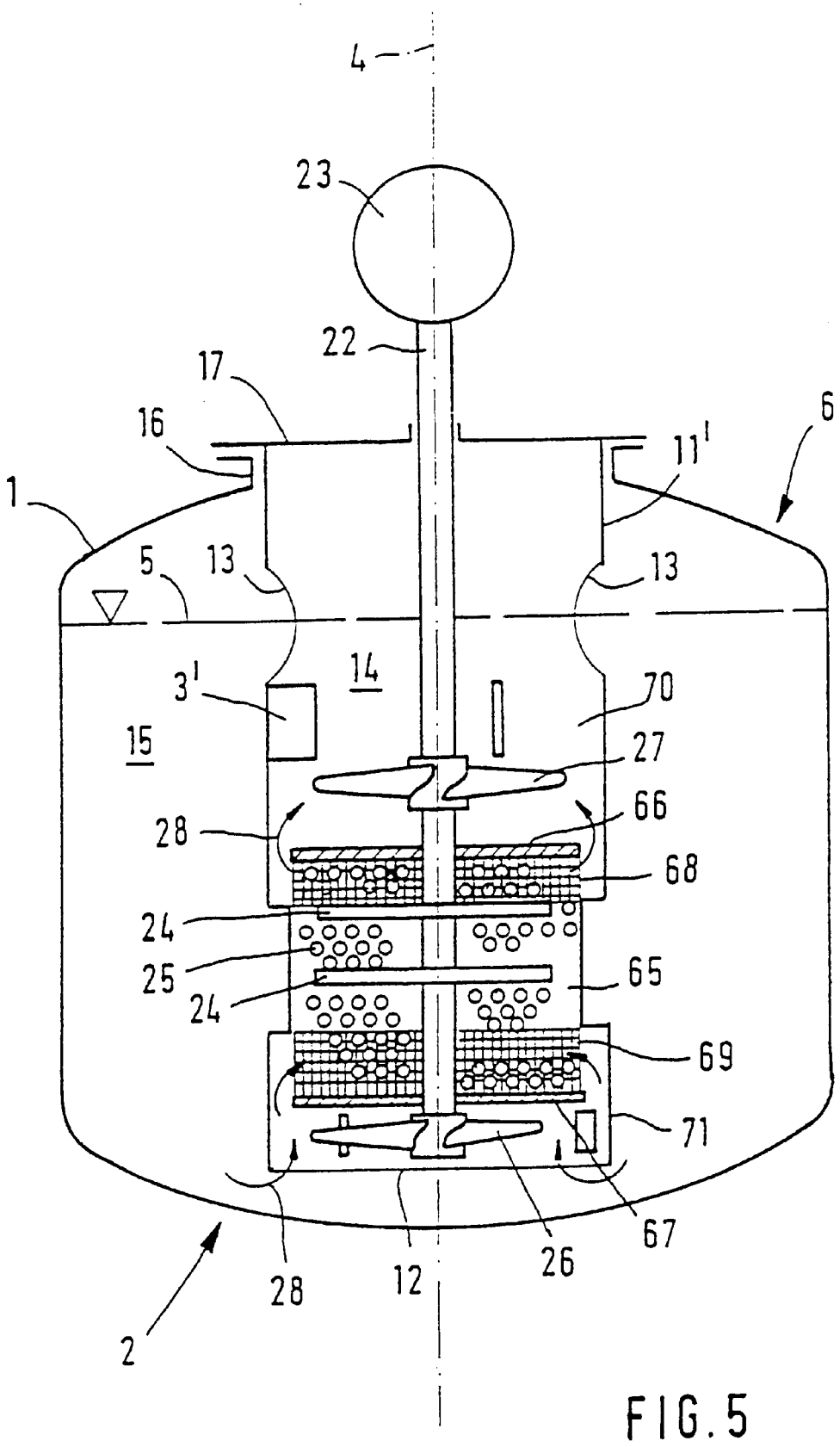

The invention is explained below in more detail with reference to the illustrative examples depicted schematically in the drawings, in which:

FIG. 1 shows a first illustrative embodiment of an apparatus according to the invention in longitudinal section;

FIG. 2 shows a second illustrative embodiment of an apparatus according to the invention in longitudinal section;

FIG. 3 shows a third illustrative embodiment of an apparatus according to the invention in longitudinal section;

FIG. 4 shows a fourth illustrative embodiment of an apparatus according to the invention in longitudinal section;

FIG. 5 shows a fifth illustrative embodiment of an apparatus according to the invention in longitudinal section;

In FIG. 1, 1 designates a pressure-tight reaction vessel, suitably set up in a fixed position. This is designed for batchwise operation and can be charged with the product to be treated, e.g. a suspension, via an inlet port (not shown) fitted in the upper region. Via an element 3 located at the lowest point of the bottom 2, the product, which is generally free-flowing, can be discharged after the treatment has been carried out. The reaction vessel 1, which is rotationally symmetric with respect to the axis 4, is charged with the suspension up to a level 5, and the upper region 6 may be equipped with an outlet line 7 for a gaseous reaction product e.g. vapor. The outlet line 7 first runs to a reflux condenser 8 in which partial condensation takes place, one component of the vapor being condensed and flowing back into the reaction vessel 1. The remaining vaporous product is finally condensed in a condenser 9 and is present at point 10 as a liquid product, which may, if necessary, be processed further.

As previously explained hereinabove, the reflux condenser 8 can be replaced by a column suitable for solving the particular separation problem.

Especially in the case of low-boiling point components it is thus possible for process heat to be removed additionally and most effectively from the reaction vessel 1.

11 designates a cylindrical insertion member, which is rotationally symmetric with respect to axis 4, extends through the upper region 6 and into the reaction vessel 1, terminating at a distance from the bottom 2, and has an end face 12 which is open on the underside. Near the upper region 6, the shell section of said insertion member 11 is provided with a series of orifices, which have a circular cross section, are preferably distributed uniformly around the circumference and form through-connections between the inner chamber 14 of the insertion member 11 and the annular chamber 15, which extends between the outer sides of the insertion member and the facing inner sides of the reaction vessel 1. In addition, the insertion member 11 is inserted, in a sealing manner, into an opening 16, which is shaped into the upper region 6 of the reaction vessel 1, and is closed at the top, likewise in a sealing manner, by a circular coverplate 17. Said coverplate 17 is fastened to the insertion member 11, preferably detachably for installation and inspection purposes.

18 designates a system of half—coils which uniformly cover the outer shell face of the reaction vessel 1, their purpose being to carry a heat transfer medium, and which form a closed conduit path which is connected, in a manner not shown, to a suitable heat source or alternatively a heat sink. Depending on the process taking place in reaction vessel 1, this system 18 serves for heating or alternatively cooling of said suspension. It is also possible for the reaction vessel to be fitted with a double-wall jacket for carrying a heat transfer medium. In addition, the reaction vessel 1 including said system 18 is provided—in a manner known not shown—with a thermally insulating covering, so that the process temperature inside the reaction vessel 1 can be controlled very largely independently of the ambient temperature.

19 designates a cylindrical grinding cage, which is disposed in the insertion member 11 or inserted thereinto, specifically in its lower region, and which occupies the entire cross section of the insertion member 11, the upper and lower end faces 20, 21 of the grinding cage being formed by perforated plates.

The lower end face 21 extends at a small distance from the bottom end face 12 of the insertion member 11.

22 designates a drive shaft which is in effective connection with a drive unit 23 disposed outside the reaction vessel 1 and thus extends through the coverplate 17. The drive unit 23 used may, in principle, be any electric drive, preferably one with variable speed, speed control being possible via a variable-speed gear or, depending on the type of the electric drive, purely electrically, e.g. via a frequency controller.

The drive shaft 22, which runs coaxially with the axis 4, furthermore extends through both endface perforated plates of the grinding cage 19 and, in addition, is supported on this grinding cage and/or the insertion member 11 in a suitable manner. Within the grinding cage 19 it carries a plurality of axially spaced grinding disks 24, which are preferably in the form of perforated disks and whose respective periphery runs at a distance from the facing inner sides of the grinding cage 19.

The grinding cage 19 contains a multiplicity of grinding balls, which may, for example, have a diameter from 1 mm to 5 mm and which may be made of ceramic material, e.g. based on aluminum oxide or zirconium oxide, of glass or of metal, e.g. alloy steel or some other steel. These grinding balls 25 may, for example, occupy about 80% of the volume of the grinding cage 19.

The holes arranged in the grinding disks 24 can be formed by any geometric shapes, e.g. slots, spirals, crosses, etc. Their purpose is to transfer the rotary motion of the grinding disks 24, which are joined to the drive shaft 22 in a torsion-proof manner, to said grinding balls 25, to act on the solids being moved through the grinding cage 19 so as to cause them to be reduced in size, and to reduce the flow resistance of the suspension through the grinding bed.

Likewise joined to the drive shaft 22 in a torsion-proof manner are delivery elements, such as a lower, i.e. situated below the end face 21, and an upper, i.e. situated above the top end face 20, propeller stirrer 26, 27. The direction of rotation of the propeller stirrers 26, 27 and, e.g., the pitch of their blades is selected so as to ensure that within the suspension occupying the reaction vessel 1 a global flow inside the insertion member 11 will result from the bottom upwards in the direction of the arrows 28, thus flowing through the grinding bed.

The delivery action of the propeller stirrers 26, 27 is promoted by virtue of them being situated within the casing of the insertion member 11, so that to this extent a guiding action is exerted on the suspension flow.

3' designates a plurality of strips which act as baffles and are arranged inside the insertion member 11 above the end face 20.

This ensures that the suspension, under the influence of the delivery action of the propeller stirrers 26, 27, enters the insertion member 11 via the bottom end face 12, flows through the grinding bed, in the process is subject to the size reduction action of the grinding balls 25, which, owing to the rotary motion, continuously roll on one another, and finally leaves the insertion member 11 through the top orifices 13 radially to the outside, i.e. in the direction of the annular chamber 15, so as to then flow back via said annular chamber 15 to the bottom 2. Owing to an at least partly spherical design of the bottom 2, but in particular in conjunction with the positioning of the propeller stirrer 26 just above the bottom, turbulence and suction are generated at this point, thus preventing solids from settling in the bottom region of the reaction vessel 1.

The reaction vessel 1—as already mentioned at the outset—is of pressure-tight design and can be heated or cooled, depending on the heat transfer medium flowing in the system 18. The vessel forms a hermetically sealed system, within which grinding processes can be carried out under vacuum or pressurized conditions, while heterogeneous reactions proceed at the same time. The reaction vessel 1 forms a simple, compact reaction system which does not require any external units and is particularly suitable for rheologically difficult systems of materials.

In the following illustrative embodiments of a grinding reactor shown in the drawings, functional elements which correspond to those shown in FIG. 1 are likewise numbered accordingly, so that a repeated description of them is unnecessary.

An essential feature of the reaction vessel 1 shown in FIG. 2 is an insertion member 28', which extends coaxially with the axis 4 and within which, again extending coaxially with the axis 4, a drive shaft 29 is supported. Joined in a torsion-proof manner to the drive shaft 29 are a plurality of axially spaced grinding disks 24, which, in terms of design and purpose, correspond to those in accordance with FIG. 1.

At its underside, the insertion member 28' has a conical extension 30, and within the insertion member 28', specifically within its lower region, a grinding cage 31 is situated whose top and bottom end faces 32, 33 are again of perforated-plate design. Instead of a vessel which globally consists of said end faces 32 and 33 and of corresponding shell faces, the vessel or the perforated cage may alternatively, however, in terms of its structure, be formed solely by said end faces 32, 33 and additionally by the walls of the insertion member 28'. In the case of the illustrative embodiment shown in FIG. 2, the bottom end face 33 at the same time constitutes the termination of the insertion member 28'. This is not strictly necessary, however.

The space axially delimited by the end faces 32, 33 serves to accommodate grinding balls 25. The drive shaft 29, which terminates at the end face at its lower end at a distance above the bottom end face 33, thus within the grinding cage 31, is of tubular design and to that extent serves to coaxially accommodate a further drive shaft 34, which extends through the entire length of the drive shaft 29 and thus also through the grinding cage 31 and, at its end projecting from the bottom end face 33, carries a stirring element of the anchor agitator 35 type. The stirring paddles of this stirring element embrace the bottom end of the insertion member 28 at a distance and project into the annular chamber 36 which exists between the outer side of the insertion member 28' and the facing inner sides of the reaction vessel 1. 3" designates a further strip inside the annular chamber 36, said strip acting as a baffle and extending in the immediate vicinity of the stirring paddles of the anchor agitator 35.

Located on the drive shaft 29, and linked thereto in a torsion-proof manner, in the immediate vicinity above the upper front end 32, is a delivery element of the type of a propeller stirrer 37, which is designed in such a way, in conjunction with the direction of rotation of the drive shaft 29, that it generates, within the suspension of the reaction vessel 1 within the insertion member 28', a flow whose direction is upwards in the direction of the arrows 28 and thus flows through the grinding bed. This flow causes the suspension to pass across, via the orifices 13, into the annular chamber 36 and a flow globally descending within the annular chamber 36 in the direction towards the bottom end face 33 of the insertion member 28', within which, owing to the action of the propeller stirrer 37, a suction effect is produced. In addition, the blades and other structural members of the anchor agitator 35 are made to run at a small distance from the bottom 2 and the walls of the reaction vessel 1, so that owing to the rotary movement of said agitator accretions of solids are prevented. Anchor agitators are generally operated at lower speeds than propeller stirrers, and therefore separate drives for these different stirrer types are provided in this illustrative embodiment according to FIG. 2.

Provided for the grinding gear, that is the system of grinding disks 24 including the propeller stirrer 37, on the one hand, and for the anchor agitator 35, on the other hand, are separate drives which in turn are preferably of variable-speed design. Thus 38 designates a drive unit which is linked to the drive shaft 34. 39 designates a further drive unit which, however, the drawing indicates only in the form of a drive wheel joined to the anchor shaft 29 in a torsion-proof manner.

An essential feature of this embodiment is that the drive shafts 29, 34, in accordance with their different intended functions, can be operated at different speeds and, if required, also with different directions of rotation. This provides more subtle options of adjusting the field of flow in accordance with the Theological characteristics of the suspension to be treated within the reaction vessel 1.

An essential feature of the illustrative embodiments shown in FIGS. 1 and 2 is that the grinding cage is arranged centrally with respect to the reaction vessel 1, and specifically coaxially with respect to its axis 4. In the case of the illustrative embodiment shown in FIG. 3, the insertion member 41, which contains a grinding cage 40, while being of cylindrical design is arranged eccentrically with respect to the reaction vessel 1. The axis 42 of the insertion member 41 extends parallel to the axis 4 of the reaction vessel 1, however. Extending in the direction of said axis 42 is a drive shaft 43 which passes through a top coverplate 44 of the insertion member 41 and, at its lower end, terminates within the grinding cage 40. On its section which extends within the grinding cage, it again carries a series of grinding disks 24.

Additionally, the drive shaft 43, above the upper end face 45 of the grinding cage 40, carries a propeller stirrer 46 which is of such a design, tailored to the direction of rotation of the drive shaft 43, that it generates suction, directed upwards in the direction of the arrows 28, within the suspension which therefore flows through the grinding bed.

47 designates the bottom end face of the grinding cage 40.

Outside the insertion member 41, the drive shaft 43 is linked to a drive unit 48, whose design can be similar to that of the drive unit 23 (FIG. 1).

The insertion member 41 is inserted in an eccentrically diposed opening 49 of the upper region 6 of the reaction vessel 1 in a sealing manner, which can be effected, for example, as indicated in the illustrative embodiment shown, by a short pipe 50, which extends coaxially with the axis 42, being seated in the manner of a flange ring.

It is essential for said seating and fitting of the insertion member 41 to be designed so as to be pressure-tight.

52 designates a drive shaft which extends coaxially with the axis 4 of the reaction vessel 1 and, at its lower end adjacent to the bottom 2, carries a stirring element of the type of a turbine impeller 51. Said drive shaft is linked, outside the reaction vessel 1, to a drive unit 53 whose design may be similar to that of the drive unit 48. In accordance with the different stirrer types, this design likewise provides for drives which are separate from one another. The eccentric arrangement of the insertion member 41 effectively acts like a baffle inside the reaction vessel 1. The turbine impeller 51 generates a field of flow which supports the flow of suspension through the insertion member 41 and thus the grinding bed.

An essential feature of the illustrative embodiment shown in FIG. 4 is that the grinding cage 54 therein, whose top and bottom end faces 45, 47 are again formed by perforated plates, is disposed in a cylindrical tubular chamber 55 which is located outside the reaction vessel 1 and whose axis, however, extends parallel to the axis 4 of the reaction vessel. The tubular chamber 55 tapers at the top and bottom, in each case adjoining the end faces 45, 47, and is through-connected to the inner chamber of the reaction vessel 1 via pipe elbows 56, 57 and connecting pieces 58, 59. In conjunction with the delivery element which is disposed above the top end face 45, is designed like a propeller stirrer 46 and is joined to the drive shaft 43 in a torsion-proof manner, it is thus possible for a suspension stream to be branched off from the reaction vessel 1 in the direction of the arrows 60 and fed back, through the grinding bed of the grinding cage 54, to the reaction vessel 1.

61 designates an insert which is rotationally symmetric with respect to axis 4, converges toward the bottom 2 in the manner of a cone or funnel and terminates in a central, circular opening 62. Extending through the opening 62 is the drive shaft 52 which, below said opening 62, carries a delivery element designed like an anchor agitator 63 and, above said opening 62, carries a delivery element designed like a turbine impeller 64. Solids which are deposited on the top of the insert 61 slide downward along this face, under the effect of gravity, and arrive via the opening 62 within range of influence of the anchor agitator 63. Owing to the centrifugalforce field generated by the latter, solids again accumulate in radially outer zones of the reaction vessel 1 and are delivered from there to the grinding bed via the connecting pieces 59. The anchor agitator 63 thus assists the flow in the direction of the arrow 60. One effect of the insert 61 is that upwelling of the suspension along the inner wall of the reaction vessel 1 is restricted in the area covered by the anchor agitator 63, which thus likewise improves the delivery action exerted in the direction of the arrows 60.

An essential feature of the illustrative embodiment shown in FIG. 5 is a grinding cage 65 whose top and bottom end faces 66, 67 are formed by closed circular plates. Those shell sections 68, 69, however, which adjoin the end faces 66, 67 are of sieve-type design, so that it is possible for suspension to flow across these sections 68, 69. The shell sections 68, 69 each project, in a rotationally symmetrical arrangement, into expanded cylindrical sections 70, 71 of an insertion member, extending within which, in a manner corresponding to the illustrative embodiment in accordance with FIG. 1, is the drive shaft 22, to which—above and below the grinding cage 65, respectively—a propeller stirrer 27, 26 is joined in a torsion-proof manner. In all other respects, the insertion member 11' formed by the cylindrical sections 70, 71 and the grinding cage 65 functionally corresponds to the insertion member 11 shown in FIG. 1.

In accordance with the delivery action exerted via the propeller stirrers 26, 27, the suspension to be treated flows via the bottom end face 12 of the insertion member 11' into the lower cylindrical section 71 and is introduced radially via the shell section 69 into the grinding bed, in turn leaving it radially at the top end of the grinding cage 65 and entering the cylindrical section 70, again leaving the latter via the radially directed orifices 13. In this way a flow which is globally directed axially downward is established in the outer annular chamber 15 of the reaction vessel 1.

The solid design of the end faces 66, 67 in the form of circular plates in the case of the illustrative embodiment shown in FIG. 5 enabled the support for the drive shaft 22 passing through these plates to be improved and the sieve area to be enlarged. Each insertion member is equipped with suitable ports for removing and introducing the grinding balls.

The illustrative embodiment according to FIG. 4 provides a particularly simple option for replacing the grinding balls and for carrying out maintenance on the insertion member or on its fittings.

What is claimed is:

1. In an apparatus for the treatment of suspensions, a pressure-tight reaction vessel for grinding and stirring operations at positive and negative pressures, said reaction vessel including a discharge element for a free-flowing reaction product in a bottom region and a supply element for the suspension to be treated in an upper region; grinding means in said reaction vessel comprising a grinding cage, said grinding cage containing grinding bodies arranged within said reaction vessel, a circulatory path within the vessel for circulation of the suspension and with said grinding cage forming an element of said circulatory path, said grinding cage being arranged within a tubular insertion member or within a bypass line so as to extend over the entire cross-section thereof; inlet and outlet-side orifices in said grinding cage for preventing the grinding bodies from passing there through and which facilitate a through-flow of the suspension, said orifices being perforated plates or integral parts of the grinding cage, on both sides of the grinding cage as viewed in a direction of flow of the suspension from the inlet-side orifice to the outlet-side orifice upstream and downstream thereof, at least one element for stirring and delivery of the suspension subjecting the suspension to an intensive circulation effect, said grinding cage being fixedly arranged inside said reaction vessel, a bottom end face of the tubular insertion member or the lower connection point of the bypass line respectively forming the inlet port of the insertion member or of the bypass line, the respective inlet port of the insertion member or of the bypass-line being situated at a distance from the bottom region of the reaction vessel whereas upper radially oriented orifices or the upper connection point of the bypass-line respectively form the outlet port of the insertion member or of the bypass-line and are situated at a distance from a top terminal wall of the reaction vessel, and a drive shaft of the grinding means carrying an arrangement of grinding disks extending through the grinding cage with the drive shaft carrying said at least one element for stirring and delivery with at least one drive unit being arranged outside the reaction vessel and being linked to the drive shaft via pressure-tight wall ports.

2. An apparatus as claimed in claim 1, wherein said at least one element for stirring and delivery is selected from the group consisting of propeller stirrers (26, 27, 37, 46), anchor agitators (35, 63) and turbine impellers (51, 64).

3. An apparatus as claimed in claim 1, comprising a joint drive unit (23, 38) for the grinding means and the stirring means.

4. An apparatus as claimed in claim 1, comprising separate drive units (38, 39, 48, 53) for the grinding means and for the stirring means.

5. An apparatus as claimed in claim 1, wherein the reaction vessel (1) is a rotationally symmetrical vessel with respect to a center longitudinal axis (4), the grinding means and the stirring means are constructed as an assembly which is rotationally symmetrical with respect to said axis (4), and said assembly is disposed inside the reaction vessel, and a chamber (15, 36) extends about the assembly.

6. An apparatus as claimed in claim 1, wherein the reaction vessel (1) is a vessel which is rotationally symmetrical with respect to an axis (4), the grinding means being constructed as an assembly which is arranged eccentrically with respect to said axis (4), and the components forming the at least one stirring means being arranged both inside and outside said assembly.

7. An apparatus as claimed in claim 6, wherein the axis (42) of the grinding means runs parallel with the axis (4) of the reaction vessel (1).

8. An apparatus as claimed in claim 2, wherein the drive units (23, 38, 39, 48, 53) are arranged outside the reaction vessel (1), the drive shafts (22, 29, 34, 43, 52) of the grinding means and/or stirring means are linked to the drive units (23, 38, 39, 48, 53) via pressure-tight wall penetrations of the reaction vessel, and the drive units (23, 38, 39, 48, 53) are of variable-speed design.

9. An apparatus as claimed in claim 1, wherein the grinding means is arranged in a bypass line which communicates with the internal space of said reaction vessel forming the circulatory path of the suspension (1).

10. An apparatus as claimed in claim 1, wherein the reaction vessel (1) is equipped with cooling or heating means.

11. An apparatus as claimed in claim 10, wherein the cooling or heating means is formed by a double-walled construction of the reaction vessel (1) which carries a heat transfer medium, or by an external coiled pipe arrangement, and the heat transfer medium is carried in a circuit containing a heat sink and/or a heat source.

12. An apparatus as claimed in claim 10, wherein the cooling means is formed by at least one reflux condenser (8).

13. An apparatus as claimed in claim 1, wherein a plurality of grinding disks (24) joined to the drive shaft (22, 29, 43) are axially spaced and arranged torsionally-resistant within the grinding cage (19, 31, 40, 54, 65), the inner chamber of the grinding cage is filled, in an adjustable filling ratio, with grinding media comprising grinding balls (25), and the grinding cage is equipped with inlet-side and outlet-side orifices which prevent the grinding media from passing through and are designed for through-flow of the suspension to be treated.

14. An apparatus as claimed in claim 13, wherein the grinding cage (19, 31, 40, 54, 65) is rotationally symmetrical with respect to the axis (4, 42) of the grinding means.

15. An apparatus as claimed in claim 13, wherein said orifices are formed by the end faces (20, 21; 32, 33; 45, 47) of perforated plates of the grinding cage (19, 31, 40, 54).

16. An apparatus as claimed in claim 13, wherein said orifices are formed by end-side circumferential sieve sections of the grinding cage (65).

17. An apparatus as claimed in claim 13, wherein the bottom end face (12) of the insertion member (11, 28', 41, 11') alternatively forms the inlet port, and upper, radially oriented orifices (13) of the insertion member form the outlet port for the suspension.

18. An apparatus as claimed in claim 17, wherein the end face (12) of the insertion member (11, 28', 41, 11') or the first connection point of the bypass line is situated at a distance from the bottom region of the reaction vessel (1), and the orifices (13) of the insertion member (11, 28', 41, 11') or the other connection point of the bypass line are situated at a distance from the top terminal wall of the reaction vessel (1).

19. An apparatus as claimed in claim 17, wherein the grinding cage (19, 31, 40, 65) is disposed at an end of the insertion member (11, 28', 41, 11') which is adjacent to the bottom end face (12) and extends axially over part of the length of the insertion member.

20. An apparatus as claimed in claim 13, wherein the insertion member (11, 28', 41, 11') is inserted in a sealing manner in a top opening (16, 49) of the reaction vessel (1), and the insertion member (11, 28', 41, 11') is sealingly closed at the top by a cover plate (17, 44) which guides the drive shaft (22, 34, 43).

21. An apparatus as claimed in claim 13, wherein the drive shaft (43) of the grinding means sealingly passes through an opening in the wall of the bypass line.

22. An apparatus as claimed in claim 21, wherein the grinding cage (54) is disposed in a tubular chamber (55) which forms an integral part of the bypass line, the tubular chamber (55) extends coaxially with respect to the axis (42) of the grinding system, and the tubular chamber (55), at the inlet and outlet side, merges via tapering pipe sections with adjoining structural elements of the bypass line.

23. An apparatus as claimed in claim 22, wherein the at least one stirring and delivery element is disposed outside the tapering pipe sections.

24. An apparatus as claimed in claim 1, wherein the bottom (2) and the upper terminal wall of the reaction vessel (1) are of a structurally spheroidal or cone-like identical design.

25. An apparatus as claimed in claim 1, wherein within the reaction vessel (1) there is at least one insert (61) which has a funnel-like central opening (62) and divides the interior of the reaction vessel (1) into two chambers which communicate via said opening so as to permit the suspension to pass therethrough, the drive shaft (52) being passed through the opening (62), and different stirring elements (63, 64) in the chambers being joined to the drive shaft (52) in a torsion-resistant manner.

26. An apparatus as claimed in claim 1, wherein the insertion member (11, 28', 41, 11') or the grinding cage (19, 31, 40, 65) is equipped with removal ports and charging ports for the grinding media.

27. An apparatus as claimed in claim 1, wherein a discharge line (7) for vaporous reaction product is disposed on the reaction vessel (1), and at least one condenser (9) is disposed in the discharge line (7).

28. An apparatus as claimed in claim 1, wherein a discharge element for a free-flowing reaction product is provided in the bottom (2) of the reaction vessel (1), and a supply element for the suspension to be treated is provided in the upper region of the reaction vessel (1).

* * * * *

UNITED STATES PATENT AND TRADEMARK OFFICE

CERTIFICATE OF CORRECTION

PATENT NO. : 5,934,579
DATED : August 10, 1999
INVENTOR(S) : W. Hiersch et al.

It is certified that error appears in the above-identified patent and that said Letters Patent is hereby corrected as shown below:

Column 2,
Line 20 "Theological" should read -- rheological --

Signed and Sealed this

Nineteenth Day of February, 2002

*Attest:*

*Attesting Officer*

JAMES E. ROGAN
*Director of the United States Patent and Trademark Office*